US007195043B1

(12) United States Patent
Neff

(10) Patent No.: US 7,195,043 B1
(45) Date of Patent: Mar. 27, 2007

(54) ROUTER GUIDE

(76) Inventor: Leslie A. Neff, P.O. Box 236, Hollister, MO (US) 65673

( * ) Notice: Subject to any disclaimer, the term of this patent is extended or adjusted under 35 U.S.C. 154(b) by 0 days.

(21) Appl. No.: 11/262,711

(22) Filed: Nov. 1, 2005

(51) Int. Cl.
*B27C 5/00* (2006.01)

(52) U.S. Cl. ..... 144/144.51; 144/144.1; 409/178; 269/254 CS

(58) Field of Classification Search ..... 144/144, 144/137, 144.1, 144.51, 144.52, 145.1, 286.1, 144/286.5, 287, 87; 409/125, 130, 178–182; 83/459, 460; 269/254 CS
See application file for complete search history.

(56) References Cited

U.S. PATENT DOCUMENTS 4,407,344 A * 10/1983 Dicke ..... 144/87
4,448,229 A 5/1984 Woods et al.
4,456,043 A 6/1984 Stocks
4,607,673 A * 8/1986 McCord, Jr. ..... 144/144.51
4,860,809 A 8/1989 Cotton et al.
4,905,745 A 3/1990 Jaeger
5,215,134 A 6/1993 Gudeman
5,318,082 A 6/1994 Von Hollen
5,472,029 A 12/1995 Ketch
5,577,717 A 11/1996 Benson
5,598,878 A * 2/1997 Wirth et al. ..... 144/144.51
5,740,847 A 4/1998 Lakso
5,765,822 A 6/1998 Mead
5,960,843 A 10/1999 Witt
6,032,706 A 3/2000 Lear
6,062,541 A 5/2000 Hampton
6,262,582 B1 7/2001 Barringer et al.
6,412,768 B1 7/2002 Peckham et al.

* cited by examiner

*Primary Examiner*—Shelley Self
(74) *Attorney, Agent, or Firm*—Stephen R. Greiner

(57) ABSTRACT

A router guide including a base member configured for attachment to a workbench in two different orientations. A clamping member is secured to the base member by threaded fasteners at each of its opposite ends so as to form a slot of variable height between the clamping member and the base member. In use, boards are positioned in the slot and held there by tightening threaded fasteners while a router bit is run along the free edge of the boards to make cuts. The router bit is steadied during cutting operations by pressing the associated router against a guide surface provided in either the clamping member or a guide plate attached to the base member remote from the clamping member.

8 Claims, 3 Drawing Sheets

ROUTER GUIDE

FIELD OF THE INVENTION

The present invention relates generally to woodworking apparatus and, more particularly, to cutter guides.

BACKGROUND OF THE INVENTION

The 45° lock miter joint is considered by many woodworkers to be one of the most difficult to make. Proper tools, like a router table with a large work surface, stiff fence, and a powerful router positioned beneath the work surface, are a necessity. Furthermore, boards being worked must be flat and well prepared to prevent exit tear-out and chipping. Finally, a high degree of skill in adjusting the height and depth of cut of a lock miter bit is needed since a lock miter joint must cut in a single pass.

Set-up of a router table for making lock miter joints is time-consuming. In order to produce matching joints, the router is moved up and down and the fence is moved back and forth to adjust the height and depth of a cut. Unfortunately, any movement of the router to adjust cutting height has an effect on both cutting depth and height and the same is true with movements of the fence.

Those brave enough to make lock miter joints are rewarded with woodwork that is beautiful and strong. Lock miter joints, as is well known, are virtually invisible and cannot be seen from the outside of an object constructed with them. Further, such joints are sturdy since they have a large surface for gluing.

SUMMARY OF THE INVENTION

In light of the problems associated with the known methods and apparatus for forming lock miter joints, it is a principal object of the present invention to provide a router guide that eliminates the need for a router table and permits a user to make bevel cuts in boards for the formation of lock miter joints quickly, easily, and with great precision. Both horizontal and vertical cuts can be made with the router guide.

It is another object of the invention to provide a router guide of the type described that requires neither prolonged training nor time-consuming set-up work to use safely and effectively. No tools other than a measuring implement, like a ruler for positioning boards, and a conventional router are required to use the router guide.

It is a further object of the invention to provide a router guide of the type described that selectively holds a board with a light pressure for preliminary positioning. Thus, a user can carefully gauge the distance between the end of the board to be cut and the guide surfaces against which a router base plate will ride while lock miter cuts are made.

It is an object of the invention to provide improved features and arrangements thereof in a router guide for the purposes described that is lightweight in construction, inexpensive to manufacture, and dependable in use.

The router guide in accordance with this invention achieves the intended objects by featuring a base member for releasable attachment to a support. The base member has a base plate and a secondary plate joined at right angles. A clamping member holds a board against the base member and has a clamping plate positioned adjacent the base plate to form a board-receiving slot. One pair of threaded fasteners secures the clamping member to the base member so that a board can be snugly, yet slidably, held therebetween. Each of these threaded fasteners has a first rod slidably extending through the clamping plate. One of the opposite ends of the first rod is affixed to the base plate and the other is free, threaded, and has a nut screwed thereon. One compressed spring is positioned about the first rod between the nut and the clamping plate. Another compressed spring is positioned about the first rod between the base plate and the clamping plate. Another pair of threaded fasteners is provided for locking a board in the slot. Each of these fasteners has a second rod slidably extending through the clamping plate. One of the opposing ends of the second rod is affixed to the base plate and the other is free and threaded. A hold down tube is positioned about the second rod above the clamping plate. A knob is screwed onto the threaded one of the opposing ends of each second rod for pressing the hold down tube downwardly onto the clamping plate.

The foregoing and other objects, features, and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
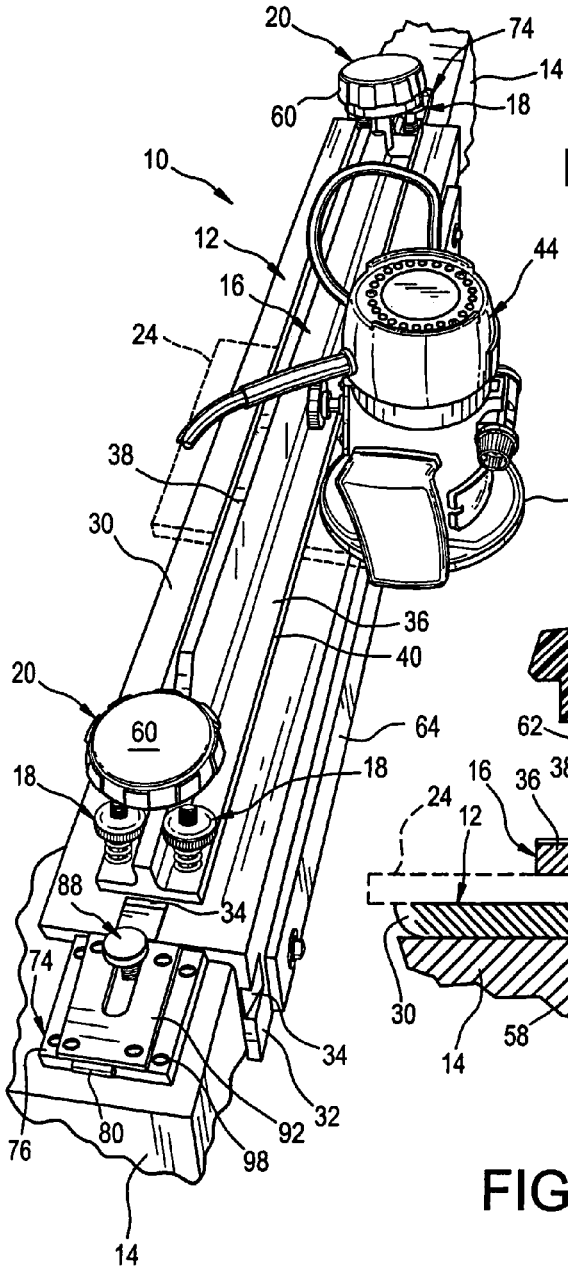
FIG. 1 is a perspective view of a router guide in accordance with the present invention in a "knobs up" condition wherein a board is held horizontally for routing.

Referring now to the FIGS., a router guide in accordance with the present invention is shown at 10. Router guide 10 includes a base member 12 adapted for attachment to a workbench 14 in two different orientations. A clamping member 16 is secured to base member 12 by means of threaded fasteners 18 and 20 at each of its opposite ends so as to form a slot 22 a variable height between clamping member 16 and base member 12. In use, boards 24 and 26 are positioned in slot 22 and held there by tightening threaded fasteners 18 and 20 while a router bit 28 is run along the free edge of boards 24 and 26 to make cuts.

Base member 12 is L-shaped in cross-section and has a base plate 30 and a secondary plate 32 affixed to one another at right angles. Plates 30 and 32 are elongated to permit boards 24 and 26 of the sort typically used by cabinetmakers to be supported thereby. The outer surfaces of plates 30 and 32, i.e., those that face away from one another, are provided with grooves 34 at their opposite ends. Each groove 34 tapers in elevation from a wide terminal end that opens outwardly from an end of either plate 30 or plate 32 to an inner end with zero or no elevation.

Clamping member 16 has a clamping plate 36 to the center of which is affixed a stiffening rib 38 so as to form a rigid, T-shaped arrangement of parts. As shown, clamping plate 36 and rib 38 have a length that is slightly less than that of base plate 30 so as to leave the area open adjacent grooves 34 therein. The front of clamping plate 36 is planar and defines a guide surface 40 upon which the base 42 of router 44 can travel. For easy, non-binding manipulation of threaded fasteners 18 and 20, rib 38 is cut away or scalloped at each of its opposed ends.

Two threaded fasteners, located at each end of clamping plate 36 and respectively positioned on opposite sides of rib 38, penetrate clamping plate 36. Each fastener 18 comprises a rod 46 that is threaded at its opposite ends with one of said ends being screwed into an internally threaded bore 48 and base plate 30. The remaining, free end of each rod 46 carries a circular nut 50 with a knurled periphery for rotation by the fingers of a user. Positioned about rod 46, between nut 50 and clamping plate 36 is a compressed spring 52 and positioned between clamping plate 36 and base plate 30 is a compressed spring 54. Tightening a nut 50 compresses both springs 52 and 54 to drive clamping member 16 toward base member 12 and reduce the height of slot 22. Springs 52 and 54, however, maintain some "give" in the positioning of clamping member 16 so that boards 24 and 26 can be moved about in slot 22 while being engaged by both of members 16 and 12 when a nut 50 is tightened.

Each fastener 20 includes a rod 56 that is threaded at its opposite ends. One of these ends is screwed into an internally threaded bore 58 located between bores 48 at an end of base plate 30. The free end of each rod 56 carries a large, threaded knob 60 with an undulating periphery for easy grasping and rotating by the fingers of a user. Positioned around each rod 56 between the bottom of knob 60 and the top of clamping plate 36 (the adjacent portions of rib 38 being cut away to provide access to clamping plate 36) is a rigid, hold down tube 62. Tube 62 transmits a strong downward pressure generated by tightening knob 60 to clamping plate 36.

A guide plate 64 is movably fastened to secondary plate 32 by means of a pair of bolts 66. The front of guide plate 64 is planar and defines a guide surface 68 against which the base 42 of router 44 can travel. Bolts 66 pass through a pair of close-fitting slots 70 respectively located at each of the opposite ends of guide plate 64. As illustrated, bolts 66 are screwed into internally threaded bores 72 at opposite ends secondary plate 32. By selectively loosening bolts 66, guide plate 64 can be moved along the outer surfaces secondary plate 32 so as to be closer to, or be farther away from, board 26 positioned in slot 22.

Clamping dogs 74 are provided at each end of base member 12 for attaching such to workbench 14 or any other, suitable supporting surface. Each of dogs 74 includes a base block 76 having a channel 78 running from one end thereof to the other end thereof. Slidably positioned in channel 78 is a bar 80 having a tapered end 82 sized for snug positioning and a selected one of grooves 34. Adjacent tapered end 82, a threaded bore 84 passes through bar 80 from top to bottom. The threaded shaft 86 of a thumbscrew 88 is positioned in bore 84 and, by rotating the knurled head 90 at the top thereof, can be screwed into engagement with the portion of block 76 forming bottom of channel 78. A cap 92 is affixed by means of threaded fasteners 94 to the top of block 76 to retain bar 80 within channel 78. Cap 92 has a slot 96 that runs parallel to the longitudinal axis of channel 78 and accommodates the threaded shaft 86 of thumbscrew 88. Thus, bar 80 can be moved so as to project tapered end 82 from block 76 by applying a light sideways pressure to thumbscrew 88 that serves as a handle. It should be noted that the opposite ends of slot 96 stops the continued movement of thumbscrew 88 thereby preventing the overextension or loss of bar 80. By selectively tightening thumbscrew 88, its threaded shaft 86 is engaged with the bottom of channel 78 driving bar 80 into engagement with cap 92 thereby locking bar 80 in place with tapered end 82 either in an extended or a retracted condition.

Figure 2:
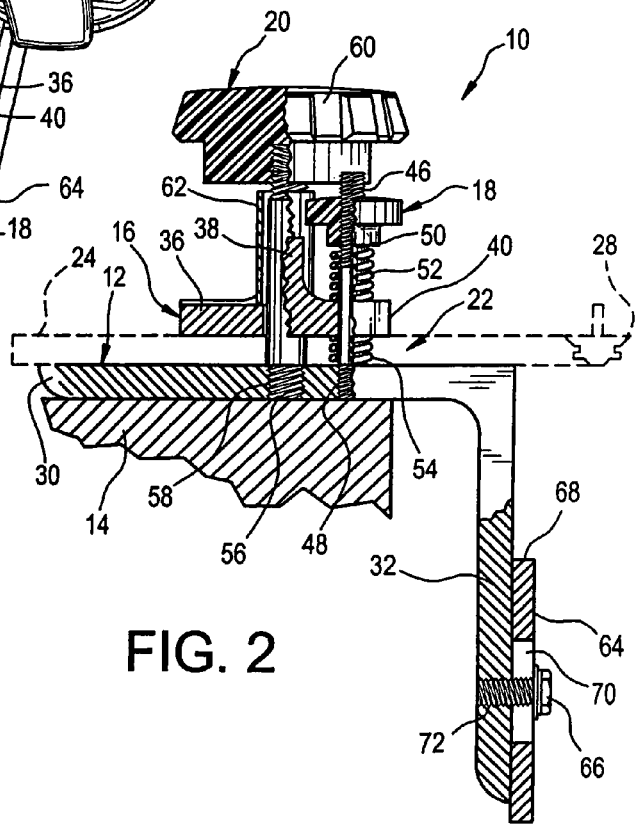
FIG. 2 is a side view of the router guide of FIG. 1 in a "knobs up" condition with portions broken away to reveal details thereof.

The use of router guide 10 to produce a "horizontal" lock miter bevel is straightforward. First, with dogs 74 being affixed to workbench 14, by means of threaded fasteners 98 passing through the corners of blocks 76, in a spaced-apart condition with tapered ends 82 of bars 80 retracted in blocks 76 and with router guide 10 remote therefrom, router guide 10 is placed between dogs 74 in a "knobs up" orientation as illustrated in FIGS. 1 and 2. Then, tapered ends 82 of bars 80 are slid into grooves 34 in base plate 30 with tapered ends 82 serving as wedges to drive base plate 30 downwardly onto workbench 14 and locked there by tightening thumbscrews 88. Next, board 24 is positioned in slot 22 so as to project forwardly from guide surface 40 of clamping plate 36 a distance required for an acceptable cut by router bit 28. When the positioning of board 24 is finalized, knobs 60 are tightened to lock board 24 in place. Now, the base 42 of router 44 is pressed against guide surface 40 of clamping plate 36 and a horizontal lock miter bevel 99 is made with router bit 28. Finally, knobs 60 are loosened and board 24 is removed from router guide 10 with bevel 99 in it.

Some trial and error work is required in positioning board 24 since the dimensions of board 24 can vary. Springs 52 and 54 permit an unlimited number of ultra-fine movements so that the positioning of board 24 can be precise. Of course, if the fit of board 24 between clamping plate 36 and base plate 30 appears to be too loose, nuts 50 are tightened. Similarly, if the fit is too tight, nuts 50 are loosened.

Figure 3:
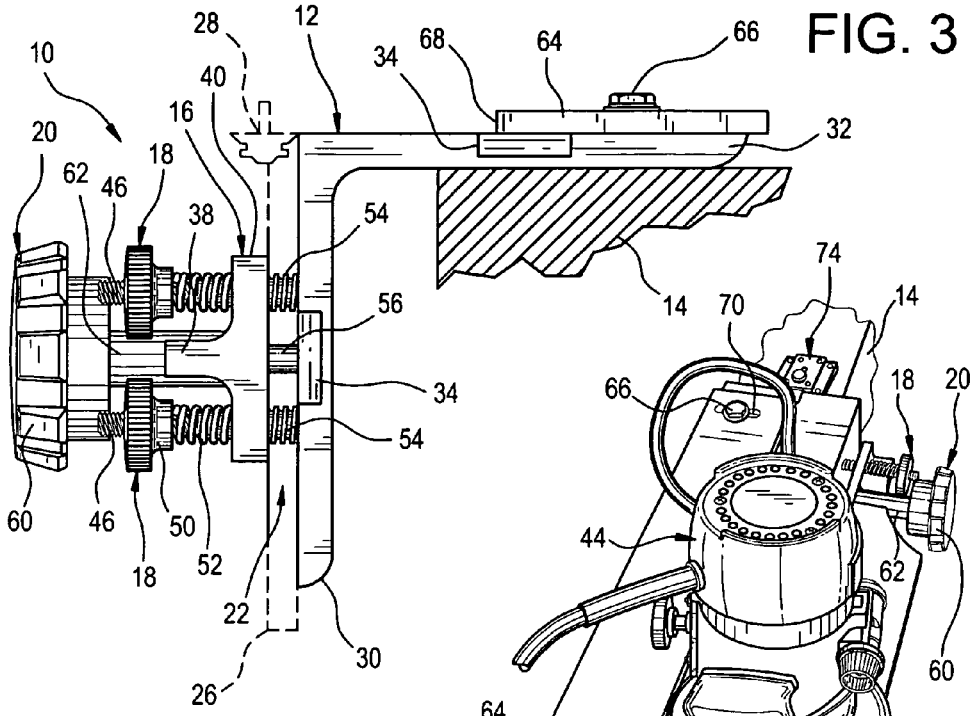
FIG. 3 is a side view of the router guide in a "knobs over" condition.
Figure 4:
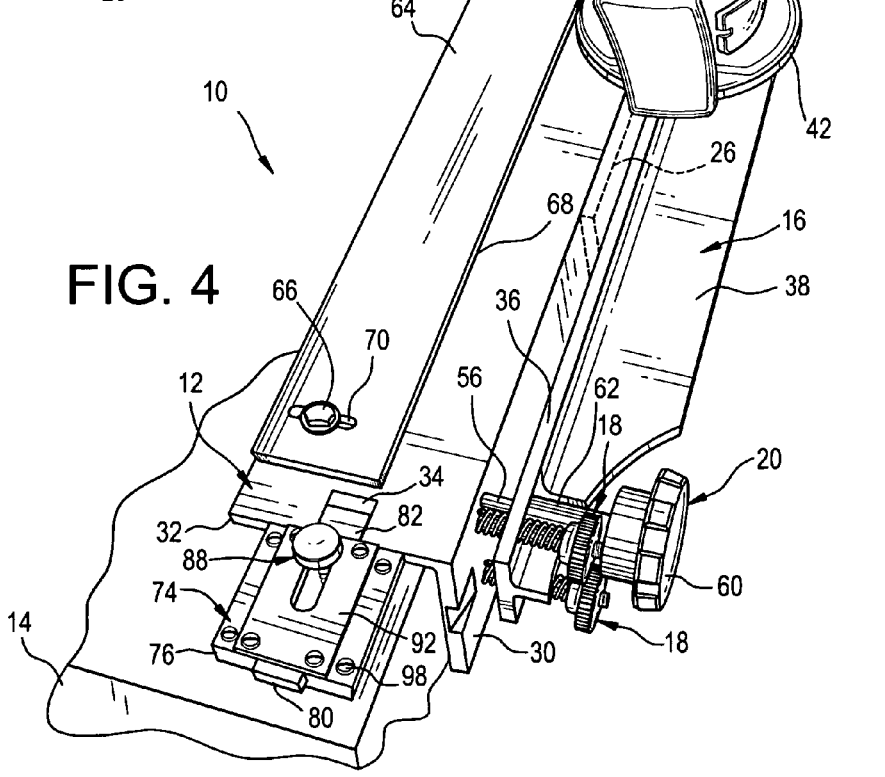
FIG. 4 is a perspective view of the router guide in a "knobs over" condition wherein a board is held vertically for cutting.

Router guide 10 can be used to produce a "vertical" lock miter bevel. Starting the process with router guide 10 in a "knobs up" condition, requires that bars 80 be retracted from grooves 34 in base plate 30 and that router guide 10 be flipped to a "knobs over" orientation as shown in FIGS. 3 and 4. Now, the tapered ends 82 of bars 80 are slid into grooves 34 in secondary plate 32 and locked in position by tightening thumbscrews 88. Subsequently, board 26 is positioned in slot 22 so that its top is substantially flush with the edge formed at the junction of base plate 30 and secondary plate 32. Knobs 60 are now tightened to lock board 26 in position. Afterward, base 42 of router 44 is pressed against guide surface 68 of guide plate 64 and a vertical lock miter bevel 100 is made in board 26 with router bit 28. Finally, knobs 60 are loosened to release board 26 for attachment to board 24. The entire cutting process requires only a few minutes to complete for a practiced user.

If bit 28 will not make a cut of sufficient depth into board 26, the position of guide plate 64 must be adjusted. To do this, bolts 66 are loosened and guide plate 64 is slid to a suitable place. Then, bolts 66 are retightened. Cutting of board 26 can proceed as before.

Figure 5:
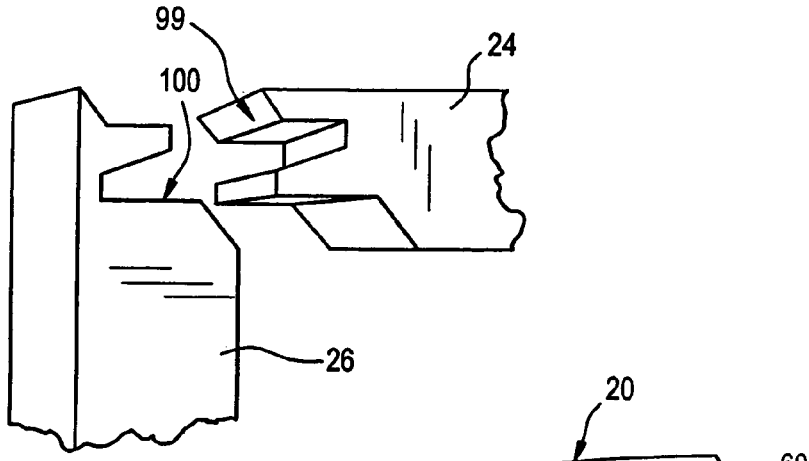
FIG. 5 is an exploded perspective view of a lock miter joint produced by a 45° lock miter router bit.
Figure 6:
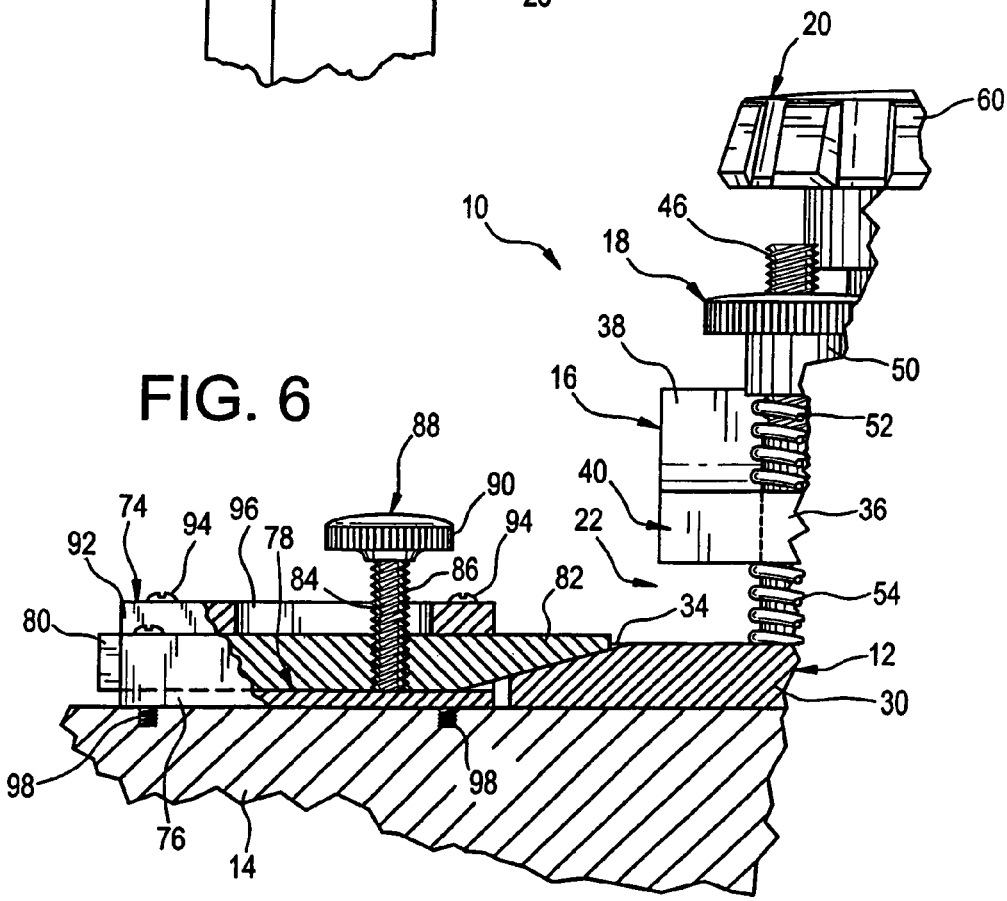
FIG. 6 is a longitudinal cross-sectional view of a dog used for releasably securing the router guide to a workbench.

Boards 24 and 26 can be joined to form part of many sorts of things including boxes, cabinets, and drawers. The joint between boards 24 and 26 is made as suggested in FIG. 5 by positioning boards 24 and 26 at right angles to one another. Glue (not shown) is placed between bevels 99 and 100 and boards 24 and 26 are clamped together. Brads (not shown)

can be driven into the ends of boards 24 and 26, if desired, to reinforce the lock miter joint that is strong, durable, and attractive to the eye.

While the router guide has described with a high degree of particularity, it will be appreciated by those skilled in the art that modifications may be made to it. For example, a movable fence or stop feature can be provided to clamping plate 36 to assist the user in aligning boards 24 and 26 prior to cutting. Further, C-clamps or screws (neither shown) can be substituted for dogs 74 for attaching router guide 10 to workbench 14 so much convenience in the repositioning of router guide 10 would be lost. This Therefore, it is to be understood that the present invention is not limited to the sole router guide embodiment described above, but encompasses any and all embodiments within the scope of the following claims.

I claim:

1. A router guide, comprising:

a base member adapted for releasable attachment to a horizontal supporting surface, said base member including:

a base plate;

a secondary plate being affixed to said base plate and extending at right angles therefrom;

a clamping member for holding a board against said base member, said clamping member including:

a clamping plate being positioned adjacent to said base plate so as to form a board-receiving slot between said clamping plate and said base plate, said clamping plate having opposed ends and a pair of apertures extending through each of said opposed ends;

a pair of first threaded fasteners for securing said clamping member to said base member so that a board can be snugly, yet slidably, held therebetween, each of said first threaded fasteners including:

a first rod slidably extending through a respective one of said apertures in said clamping plate and having opposite ends, one of said opposite ends being affixed to said base plate and the other of said opposite ends being free and threaded;

a nut being screwed onto the threaded one of said opposite ends of said first rod;

a first compressed spring being positioned about said first rod between said nut and said clamping plate;

a second compressed spring being positioned about said first rod between said base plate and said clamping plate;

a pair of second threaded fasteners for locking a board between said clamping member and said base member, each of said second threaded fasteners including:

a second rod slidably extending through a respective one of said apertures in said clamping plate and having opposing ends, one of said opposing ends being affixed to said base plate and the other of said opposing ends being free and threaded;

a hold down tube being positioned about said second rod above said clamping plate; and, a knob being screwed onto the free and threaded one of said opposing ends of said second rod for pressing said hold down tube downwardly onto said clamping plate when tightened.

2. The router guide according to claim 1 wherein said base plate and said secondary plate both have terminal ends opposite one another and a plurality of grooves each being positioned in a respective one of said terminal ends, and said router guide further comprising a pair of dogs for releasably securing said base member to a workbench, each of said dogs including a slidable bar for selective positioning in one of said grooves.

3. The router guide according to claim 2 wherein each said slidable bar has a tapered end for insertion into one of said grooves.

4. A router guide, comprising:

a base member adapted for releasable attachment to a horizontal supporting surface, said base member including:

a base plate;

a secondary plate being affixed to said base plate and extending at right angles therefrom;

a clamping member for holding a board against said base member, said clamping member including:

a clamping plate being positioned adjacent to said base plate so as to form a board-receiving slot between said clamping plate and said base plate, said clamping plate having opposed ends and a pair of apertures extending through each of said opposed ends;

a stiffening rib being affixed to said clamping plate and extending substantially the length thereof;

a pair of first threaded fasteners for securing said clamping member to said base member so that a board can be snugly, yet slidably, held therebetween, each of said first threaded fasteners including:

a first rod slidably extending through a respective one of said apertures in said clamping plate and having opposite ends that are threaded, and one of said opposite ends being screwed into said base plate;

a nut being screwed onto the one of said opposite ends of said first rod not being screwed into said base plate;

a first compressed spring being positioned about said first rod between said nut and said clamping plate;

a second compressed spring being positioned about said first rod between said base plate and said clamping plate;

a pair of second threaded fasteners for locking a board in placed between said clamping member and said base member, each of said second threaded fasteners including:

a second rod slidably extending through a respective one of said apertures in said clamping plate and having opposing ends that are threaded, and one of said opposing ends being screwed into said base plate;

a hold down tube being positioned about said second rod above said clamping plate; and, a knob being screwed onto the one of said opposing ends of said second rod not being screwed into said base plate for pressing said hold down tube downwardly onto said clamping plate when tightened.

5. The router guide according to claim 4 wherein said base plate and said secondary plate both have terminal ends opposite one another and a plurality of grooves each being positioned in a respective one of said terminal ends, and said router guide further comprising a pair of dogs for releasably securing said base member to a workbench, each of said dogs including a slidable bar for selective positioning in one of said grooves.

6. The router guide according to claim 5 wherein each said slidable bar has a tapered end for insertion into one of said grooves.

7. A router guide, comprising:

a base member adapted for releasable attachment to a horizontal supporting surface, said base member including:

a base plate;

a secondary plate being affixed to said base plate and extending at right angles therefrom;

a clamping member for holding a board against said base member, said clamping member including:

a clamping plate being positioned adjacent to said base plate so as to form a board-receiving slot between said clamping plate and said base plate, said clamping plate having opposed ends and a pair of apertures extending through each of said opposed ends, said guide plate having a first guide surface for steadying a router base engaged therewith;

a pair of first threaded fasteners for securing said clamping member to said base member so that a board can be snugly, yet slidably, held therebetween, each of said first threaded fasteners including:

a first rod slidably extending through a respective one of said apertures in said clamping plate and having opposite ends, one of said opposite ends being affixed to said base plate and the other of said opposite ends being free and threaded;

a nut being screwed onto the threaded one of said opposite ends of said first rod;

a first compressed spring being positioned about said first rod between said nut and said clamping plate;

a second compressed spring being positioned about said first rod between said base plate and said clamping plate;

a pair of second threaded fasteners for locking a board between said clamping member and said base member, each of said second threaded fasteners including:

a second rod slidably extending through a respective one of said apertures in said clamping plate and having opposing ends, one of said opposing ends being affixed to said base plate and the other of said opposing ends being free and threaded;

a hold down tube being positioned about said second rod above said clamping plate; and, a knob being screwed onto the free and threaded one of said opposing ends of said second rod for pressing said hold down tube downwardly onto said clamping plate when tightened.

8. The router guide according to claim 7 further comprising a guide plate movably fastened to said secondary plate of said base member, said guide plate having a second guide surface for steadying a router base engaged therewith.

* * * * *